United States Patent [19]

Ottlik, deceased

[11] Patent Number: 4,715,204

[45] Date of Patent: Dec. 29, 1987

[54] METHOD AND APPARATUS FOR ACCURATELY CENTERED ALIGNMENT OF A HOLLOW ROTATION SYMMETRICAL WORKPIECE

[75] Inventor: Norbert Ottlik, deceased, late of Augsburg, Fed. Rep. of Germany, by Klara Ottlik, Elisabeth Nowak, heirs

[73] Assignee: M.A.N. Roland Druckmaschinen Aktiengesellschaft, Offenbach am Main, Fed. Rep. of Germany

[21] Appl. No.: 828,829

[22] Filed: Feb. 12, 1986

[30] Foreign Application Priority Data

Feb. 23, 1985 [DE] Fed. Rep. of Germany ..... 3506450

[51] Int. Cl.[4] ..... B21D 3/10; B21J 7/32; B21J 7/46

[52] U.S. Cl. ..... 72/76; 72/370; 72/443; 72/466

[58] Field of Search ..... 72/31–35, 72/76, 81, 53, 421, 370, 437, 452, 441–443, 10, 119–123

[56] References Cited

U.S. PATENT DOCUMENTS

| | | | |
|---|---|---|---|
| 1,079,065 | 11/1913 | Pilston | 72/76 |
| 1,374,877 | 4/1921 | Carlson | 72/421 |
| 1,790,515 | 1/1931 | Trumble | 72/452 |
| 2,071,281 | 2/1937 | George | 72/452 |
| 2,205,784 | 6/1940 | Arutunoff | 72/34 |
| 2,333,640 | 11/1943 | Clark | 72/32 |
| 2,818,102 | 12/1957 | Seifferle | 72/392 |
| 3,837,203 | 9/1974 | Ruth | 72/106 |
| 3,866,447 | 2/1975 | Ritchie | 72/9 |
| 4,416,130 | 11/1983 | Judge, Jr. | 72/76 |

FOREIGN PATENT DOCUMENTS

| | | | |
|---|---|---|---|
| 1627605 | 1/1971 | Fed. Rep. of Germany . | |
| 1948752 | 4/1971 | Fed. Rep. of Germany . | |
| 1,592,142 | 6/1970 | France . | |
| 190723 | 11/1982 | Japan | 72/392 |

*Primary Examiner*—Lowell A. Larson

*Attorney, Agent, or Firm*—Frishauf, Holtz, Goodman & Woodward

[57] ABSTRACT

An operating head (24) carrying a hammering element (28) is introduced into the interior of the workpiece at a position where the workpiece, as measured by a measuring instrument (49,50) shows maximum deviation from the axis of rotation of the rotation symmetrical body. The hammering element is controlled to hammer against the inside at a rate which depends on the distance of deflection and/or the position thereof, during rotation, or longitudinal movement of the workpiece with respect to the operating head, for example by controlling a potentiometer (19) by an eccentric control disk (16) which has its maximum eccentric deflection of position in line with the maximum eccentricity, or deflection of the workpiece (7) from the axis of rotation. The apparatus can also be used to remove dents and the like, by hammering against the dent and longitudinally shifting the workpiece with respect to the hammering element. Preferably, the outside of the wall is resiliently supported by a counter element (39,40), the hammering element being operated by a cam (26) under constant spring force.

19 Claims, 4 Drawing Figures

METHOD AND APPARATUS FOR ACCURATELY CENTERED ALIGNMENT OF A HOLLOW ROTATION SYMMETRICAL WORKPIECE

The present invention relates to a method to fashion a hollow workpiece which is rotation symmetrical, for example a hollow cylinder to be in centered alignment with the central axis thereof.

Rollers and cylinders for printing machines can be made of cylindrical cut pieces from tubes, obtained by radial cutting of the necessary length from a long tubular section. The walls of the tubes, however, are not necessarily concentric with a central axis passing through the tube.

THE INVENTION

It is an object to provide a method and an apparatus for working on the tubes so that the outer cylindrical wall will be concentric with the axis, requiring a minimum of time and resulting in a tube having only minimum tolerances from a precise symmetrical form.

Briefly, a rotation symmetrical body which, typically, is a cylindrical tube section—but which may be a conical element—is placed in a rotatable holder, such as chuck, and supported at a free end by a suitable holder. An operating head is axially slidable with respect to the workpiece, movable into the hollow interior thereof. The operating head includes a hammer-type operating element. Any eccentricity with respect to a central axis is sensed and the hammering-type operating element on the operating head is moved within the workpiece to the point of maximum deviation of the wall of the rotation symmetrical element from centricity, the wall opposite the maximum deviation being hammered to restore centricity to the overall structure.

DRAWINGS

DETAILED DESCRIPTION

Figure 1:
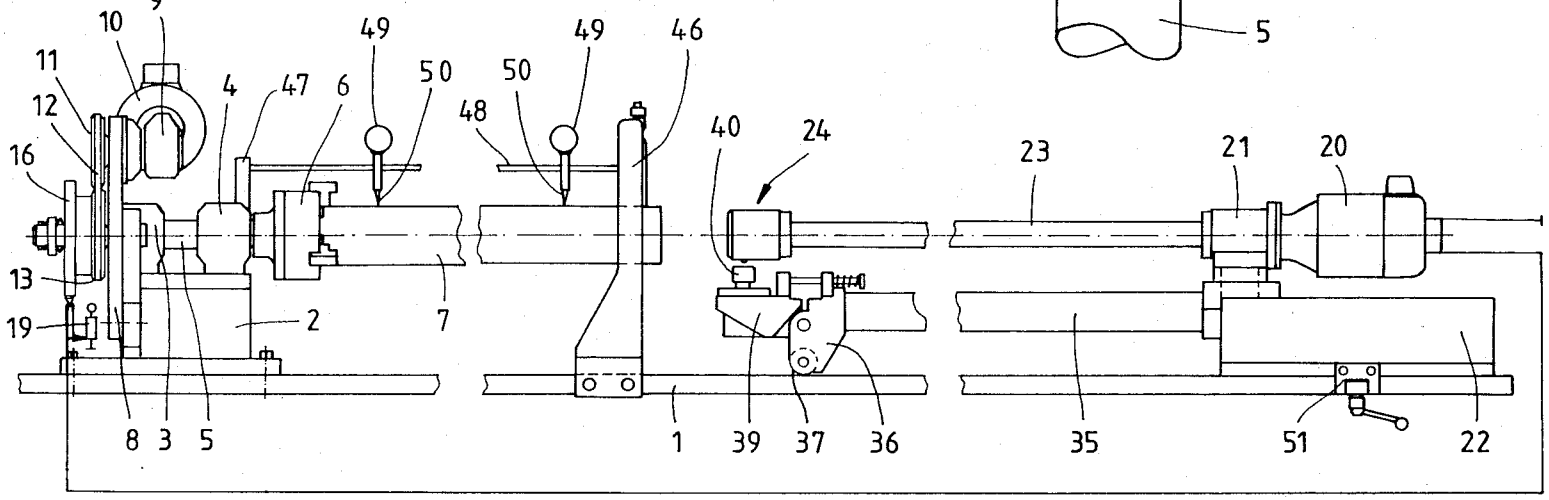
FIG. 1 is a schematic side view of the apparatus, illustrating restoration of a cylindrical tube structure to centricity.

A base plate 1—see FIG. 1—supports a block 2 at one end thereof. The block 2, in turn, supports two bearings 3,4 for a drive shaft 5 of a holder 6, formed as a chuck for a hollow cylindrical workpiece 7. The workpiece 7, for example a portion of a tube, is to be accurately aligned with respect to a central axis thereof, shown in chain dotted representation in FIG. 1. The block 2, further, forms a holder for a reduction gearing 9 and a motor 10. A V-belt pulley 11 drives a driven pulley 13 by a V-belt 12. Pulley 13 forming a drive wheel is securely seated on the drive shaft 5.

Figure 2:
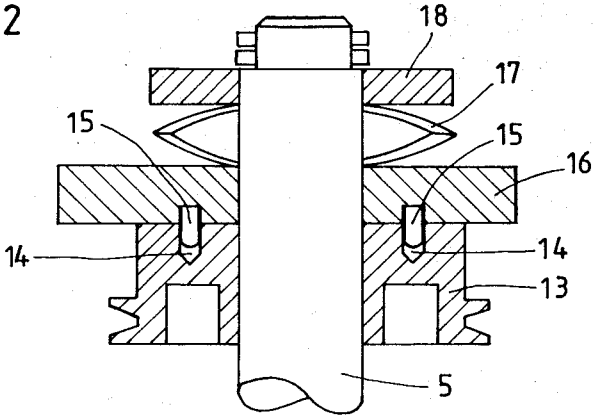
FIG. 2 is a part sectional axial view illustrating a portion of the apparatus of FIG. 1.

The drive wheel or pulley 13—see FIG. 2—is formed with a plurality of bores 14, extending parallel to the axis of the shaft 5. The bores 14 can be engaged with coupling pins 15 located on a control disk 16. A spring 17 is provided to retain the coupling pins 15 in the respective bores 14. Bores 14 are circumferentially located, at suitable angular displacements, about a circle, concentric with the axis of shaft 5. The coupling spring 17 is supported on the flange 18, secured to the shaft 5. The combination of the pins 14, control disk 16 and spring 17 forms a positive engagement clutch. Rather than the clutch shown, other types, for example friction clutches may be used.

The control disk 16 has a circular circumference and is eccentrically located on the shaft 5, to be rotatable with respect thereto. The control disk 16 is coupled to a feeler, similar to a cam follower, which, in turn, is connected to the slider of an electrical potentiometer 19—see FIG. 1. The coupling between the feeler engaging the disk 16 and the slider of the potentiometer 19 is so arranged that, upon rotation of the control disk, the slider of the potentiometer will move up-and-down, with respect to FIG. 1. The potentiometer 19 is coupled to an electric motor 20, for example by being serially coupled thereto or to provide a control output for the motor 20. The speed of the motor 20, thus, can be continuously changed as the control disk rotates.

The motor 20 is securely connected to a bearing block 21. Bearing block 21 is located on a longitudinal slide element 22. The slide element 22 is guided, for longitudinal sliding movement on the base plate 1. Its longitudinal position can be locked by a clamp 51. Clamp 51 can be manually controlled.

Figure 4:
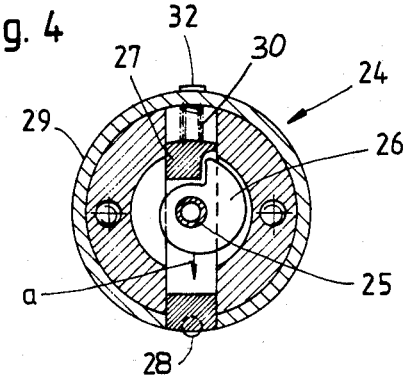
FIG. 4 is an axial sectional view along the line IV—IV of FIG. 3.
Figure 3:
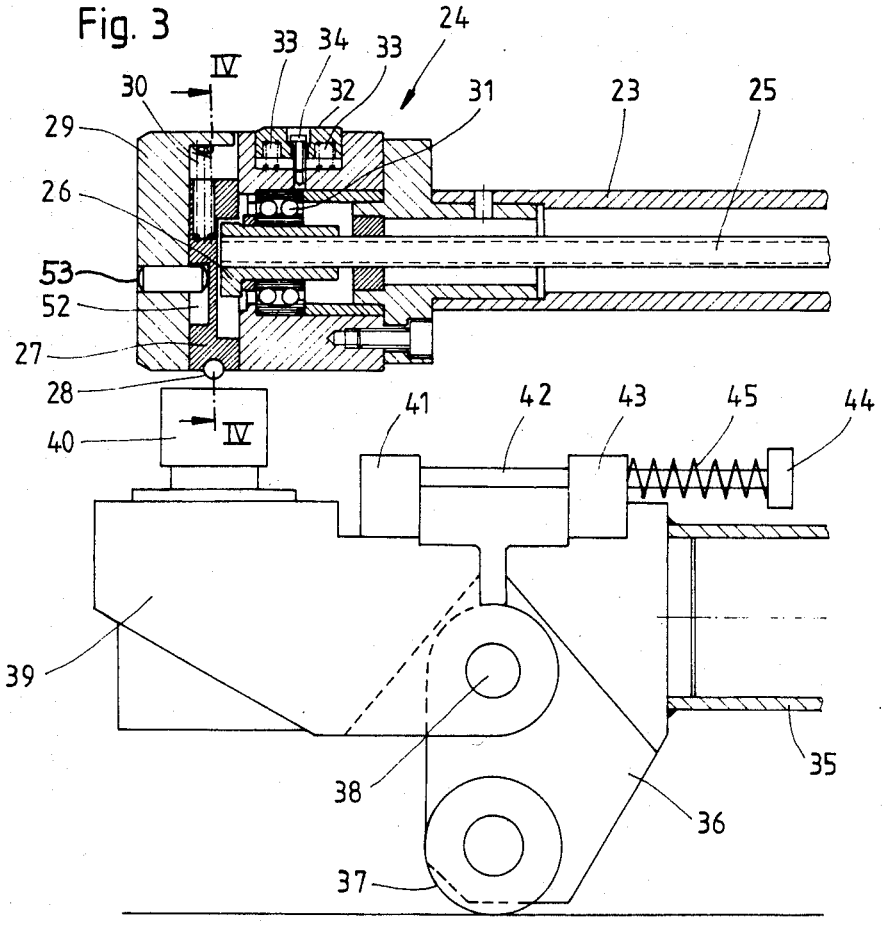
FIG. 3 is a longitudinal sectional view through the operating head, and a counter bearing provided on the apparatus of FIG. 1.

A working or operating head is connected to the bearing block 21 by hollow carrier 23. As best seen in FIG. 3, a drive shaft 25 extends through the tube 23 carrying the operating head 24. The drive shaft 25 is coupled with one end to the motor 20. The other end of the drive shaft 25 has a cam 26 connected thereto. The cam 26 within the head 24 cooperates with a transversely movable slider 27. The slider 27, moving radially, has a hammering or pressure element 28 at its outer end. The hammering element 28 may, for example, be in form of a ball which, preferably is of hardened material. Rather than using a ball, other round elements may be used, for example cylindrical elements, rods, pins or the like, located with their axes parallel to the axis of the drive shaft 25. Now spherical shape elements, for example egg-shaped or elliptical elements may be used. A spring 30 is located between the slider 27 and a cover 29 of the head 24, the spring being positioned to press the slider 27 in the direction of the arrow A (FIG. 4). The movement of the pressure or hammering element in the direction of the arrow A outwardly is thus independent of the speed of operation of the cam 26, so that the force always will be constant. The slider is formed with a groove-like recess 52—see FIG. 3—which extends in radial direction and which is engaged by a pin 53, securely seated in an end face of the cover 29. The pin 53 limits the radial excursion of the slider. Slider 27 and the engagement 28 together form a hammering element.

A support cup 32 is located in the top region, preferably above a bearing 31 surrounding the shaft 25, and located just inwardly of the end 26 of the shaft 25, for example retained by the cam 26. Compression springs 33 are located between the support cup 32 and the outer surfaces of the head 24, tending to push the outer surface of the support cup 32 outwardly. The highest excursion of the support cup can be limited by the position of a screw 34, fitted into an opening extending through the support cup 32 and tapped into the head 24.

A plurality of support cups 32 of this construction—which is preferred—or of similar constructions may be located on the head 24, for example offset relatively to each other by 90°.

A further support element 35 is provided extending parallel to the support rod or tube 23, and secured to the slider 22. The support rod 35 has two plate metal brakets 36 attached thereto, located for example laterally on each side of the rod 35. Only one of the brakets 36 is visible in the drawings. A roller, or caster 37 is retained between the brakets 36. The caster 37 is guided for longitudinal movement on the base plate 1. A bolt 38, located on the braket 36 retains a block 39 forming a counter bearing, and having an engagement surface element 40 secured thereto. The counter bearing element 39 has an extension 41, in which a screw 42 is screwed. The screw 42 passes freely through a block 43, securely connected to the support rod 35, by an opening larger than the diameter of the screw 42. A spring 45 is held, in compression, between an end nut, or head 44 on the screw 42, engaging a face of the block 43, and tending to hold the counter element 39 in the position shown in FIG. 3.

A tailstock 46, permitting free access into the interior of the workpiece 7 is further secured to the base plate 1. If workpieces of different length are to be worked on, the tailstock 46 may be secured to the base plate 1 to be slideable longitudinally with respect thereto, and clamped in position.

A measuring arrangement is secured between the tailstock 46 and the block 2, formed by a support shaft 48, secured to a holder 47 attached to the block 2 and the tailstock 46, respectively. The shaft 48, for example, formed as a rod, extends parallel to the axis of the workpiece 7 clamped in the chuck 6. A plurality of dial measuring elements 49 are located on the shaft 48, axially slidable thereon. Upon rotation of the shaft 48, the dial gauges 49 can be tilted, simultaneously, from a rest position to a measuring position, in which measuring pins 50 of the elements 49 engage the workpiece 7, and extend perpendicularly to the circumferential wall thereof. They can be moved axially along the surface of the workpiece, and, should have a range of movement which corresponds to the range of movement of the hammering element 28 in the head 24. The rotary movement of the shaft 48 can be limited by providing suitable stops therefor. Basically, it is sufficient to have a single dial measuring element, axially slidably positioned on the shaft 48. Measuring and calibrating workpieces can be substantially facilitated and speeded, however, if a plurality of dial gauges 49 are provided, so that, simultaneously, deflections and deviations from centricity of the workpiece 7 with respect to the longitudinal axis thereof can be determined.

Operation, and Method of Alignment of a rotation-symmetrical workpiece

A hollow cylindrical workpiece is clamped in the chuck 6 and located in the tailstock 46 so as to be rotatable therein, while permitting access to the interior of the hollow workpiece. Typically, the workpiece will be a tube section, that is, will be hollow-cylindrical. After clamping the workpiece 7, the dials 49 are rotated into measuring position, in which the measuring pins 50 engage the outer wall of the workpiece 7. The motor 10 is started at a "creep" speed to slowly rotate the workpiece 7. Observation of the gauges 49 permits determination of eccentricity of the outer wall surfaces of the workpiece 7 with respect to the longitudinal axis of rotation thereof.

Let it be assumed that the workpiece 7 is a tubular element which is not precisely straight, but slightly bowed or bent, for example approximately in the middle thereof. The workpiece 7 is rotated—for example by the motor 10, or manually, until that wall surface of the workpiece 7 is engaged by the measuring pin 50 which has the greatest deflection from desired or command value. Maximum deformation work must, therefore, be applied against the inner walls of the workpiece at that position. In the required position, thus, the motor 10 is stopped, and the disk 16 is disengaged from the V-belt pulley 13, and then so adjusted that the position of maximum eccentricity faces the potentiometer 19. In this position, the disk 16 is again engaged with the V-belt pulley 13.

In a next working step, the slider 22 with the head 24 is moved into the interior of the workpiece 7 until the hammering element 28 is located in the plane of the dial which has indicated the maximum deviation from command value. The motors 10 and 20 are next connected. The motor 10 slowly rotates the workpiece 7. The motor 20 rotates the cam 26 by rotating the shaft 25 to which cam 26 is connected. The motor 20 rotates the cam at the speed of between about 600 to 1000 rpm, so that the cam 26 will cause oscillation of the hammering element 28 with a hammering frequency corresponding to the speed of the shaft 25, that is, about 600 to 1000 strokes per minute. The largest deformation work applied to the workpiece 7, thus, will occur in the region of the greatest deflection from standard or desired circumferential position of the wall of the workpiece 7. The slow rotation of the workpiece 7 will cause the disk 16 likewise to rotate. Since disk 16 is coupled to the potentiometer 19, the speed of the motor 20 will be controlled by the position of the slider of the potentiometer 19. The arrangement is so made that the speed of the motor 20 continuously decreases until the workpiece 7 has rotated by 180°, at which point the motor 20 will be stopped entirely for a short period of time, or to operate at a very slow speed so that this portion of the workpiece practically will, essentially not be subjected to deforming energy from the hammering element 28. As the motor 10 continues to rotate, the speed of the motor 20 will rise—as the slider of potentiometer 19 moves—until the maximum speed of the motor is reached. Thus, a continuously increasing deformation energy is applied to the inner wall of the workpiece 7.

The deformation energy applied to the inner wall of the workpiece 7 thus changes continuously with the rotary position of the workpiece; this ensures that the roundness, or circular cross-section of the workpiece 7 is maintained.

The hammering element, or pressure element 28, during application of energy therefrom, is countered or supported by engagement of the engagement surface 40 of the support element 35 with the outer wall of the workpiece 7. Thus, the wall of the workpiece 7 is externally supported during the operation of the head 24, that is, when the pressure element 28 is moved by the motor 20. Additionally, the wall is supported by the cap or caps 32. If the wall thickness of the workpiece 7 is substantial, it may be possible to eliminate the counter element 39 and/or the support caps 32.

When the gauges or dials 49 indicate that the deflection from centricity of the workpiece from centered position in the plane, in which the pressure element 28 is operated, is within tolerance, head 24 is then moved into the radial plane of adjacent dials in order to hammer-out any still present deflections from centricity, with respect to the axis of rotation, in a manner as described above.

The method does not require that the element 28 first operates in the plane of the greatest deflection from design value; it is equally possible to start the process in the plane of a measuring dial which does not indicate maximum deflection.

It may occur that, upon first measuring a workpiece 7 which has just been clamped in the apparatus, and has not yet been worked on, that the wall of the workpiece is not round in one plane, for example is slightly oval, with a bulging, and a depressed portion—with respect to a circle. Upon rotation of the workpiece 7, the position of maximum depth of a dent is determined. The workpiece 7 is then rotated by 180°, and the disk 16, again, is so set that the motor 20 will, in that position, cause maximum deformation force to be applied against the dent at the maximum depression. Motor 10 is then disconnected, and motor 20 which will operate at maximum speed, is energized to move the hammering element 28. The slider 22 is released from the clamp 51 and moved axially back and forth within the region of the dent or depression, until the hammering element 28 has removed the dent. The position of the workpiece 7 in the apparatus is facilitated for removing dents and the like therefrom by providing a circumferential graduation and scale on the disk 16, which can be set with respect to a fixed marker located in a position fixed with respect to the base or frame 1, for example positioned at, or opposite the potentiometer 19.

The invention has been illustrated in connection with centering a tubular structure; it is equally possible to center other types of rotation-symmetrical bodies, which are open at least at one end. Rather than using electric motors, as shown and described, other types of motors may be used, for example pneumatic or hydraulic motors for operating the hammering element and to rotate the workpiece.

Various changes and modifications may be made within the scope of the inventive concept.

Axial movement of the slide 22 can be automatically controlled by a feed motor axially oscillating the head 24 when removing a dent, for example under control of a potentiometer similar to potentiometer 19 and sensing measured deflection, for example by a pin similar to pin 50 of the instruments 49. The potentiometer, deflection position sensor 16 or 50 and motor 20 may form a closed control loop.

We claim:

1. Apparatus for insuring accurately centered alignment of all portions of a rotation symmetrical hollow workpiece (7) comprising a base or frame structure (1);

rotatable holder elements (6,46) for clamping the workpiece (7) at its ends, one (6) of the holder elements forming a rotatable chuck (6), mounted on said base structure;

drive means (9, 10) coupled to the chuck for rotation of the chuck (6) and for continuously rotating the chuck and hence the workpiece (7) during operation of the apparatus;

an operating head (24) axially slidable with respect to the workpiece (7) mounted on the base structure;

means for movably adjustably supporting the operating head within the hollow interior of the workpiece (7);

an oscillating operating element (28) located on the operating head for oscillating against the inner wall of the workpiece at a location within the workpiece where a wall portion thereof is out of centered alignment with the axis of rotation of the workpiece;

force means (26, 30) operatively coupled to the operating element (28) for oscillating the operating element in a direction transverse to the axis of rotation of the rotation symmetrical workpiece;

adjustable control means (13–19) operatively coupled to the operating element (28) and controlling the eneregy applied by the force means in a direction to null deviation of the wall of the hollow workpiece from concentricity with respect to the axis of rotation of the workpiece; and wherein the adjustable control means are responsive to the angular position of the workpiece (7) with respect to the operating head, control the application energy of the force means for maximum application of deformation energy at the position of maximum deviation of the wall of the hollow workpiece from concentricity, and control the frequency of oscillation of the operating element as a function of the angular position of the maximum distortion with respect to the operating head.

2. Apparatus according to claim 1, wherein the control means control the force means to apply zero energy at said opposite position.

3. Apparatus according to claim 1, wherein the operating head (24) includes a spring (30) positioned to press the operating element (28) in a first terminal position, and the force means includes a cam, engaging the operating element and compressing the spring, the cam being rotated to permit the spring to press the operating element, in oscillating movement, against the inner wall of the workpiece at a repetition rate dependent on the speed of rotation of the cam; and wherein the rotary speed of the cam is controlled by said adjustable control means.

4. Apparatus according to claim 1, wherein the operating element (28) comprises a hammer element.

5. Apparatus according to claim 1, wherein the operating element (28) comprises a hammer element.

6. Apparatus according to claim 1, wherein the operating head comprises an essentially circular head;

the operating element (28) includes a slider (27) movably diametrically in the operating head;

a spring tending to push the slider, and hence the operating head, outwardly;

and a cam (26) operatively coupled to the slider and moving the slider against the force of the spring, the cam being shaped to permit sudden release of the slider, and hence application of force by the slider against the inner wall of the workpiece under force of the spring.

7. Apparatus according to claim 6, further including at least one support element (32) located on the operating head and providing support to an inner wall portion of the workpiece (7) in a direction opposite to the direction of applied force by said operating element.

8. Apparatus according to claim 1, wherein the operating element comprises a pressure element formed as at least one of: a ball; a cylinder having an axis parallel to the axis of rotation of the workpiece.

9. Apparatus according to claim 1, further including at least one dial deflection measuring instrument (49);

a support shaft (48) extending parallel to the workpiece, the instrument (49) being secured to the support shaft;

and wherein the support shaft (48) is rotatable to, selectively, engage a measuring pin (50) on the instrument (49) with a circumferential outer wall portion of the workpiece (7) or to disengage the measuring pin from the workpiece.

10. Apparatus according to claim 1, wherein the control means comprises a control disk (16) coupled to and rotating with the chuck (6) and selectively rotationally angularly positionable with respect to the chuck;

and a position sensor (19) coupled to sense the instantaneous rotary position of the control disk, the position sensor being coupled to control the energy of the force means as a function of the rotational position of the control disk;

the drive means rotating the chuck, and hence the workpiece and control disk.

11. Apparatus according to claim 10, further including a selectively engageable and disengageable clutch (14,15,17,18) coupling the control disk to a shaft (5) secured to the chuck (6);

a drive wheel (13) coupled to the shaft (5);

a motor (10) driving the drive wheel (13), the clutch, selectively, permitting change of the position of the control disk (16) with respect to the rotary position of the drive wheel (13).

12. Apparatus according to claim 11, wherein the clutch comprises a plurality of interengaging projection and—recess means formed, respectively, on the control disk (16) and on the drive wheel (13).

13. The apparatus of claim 10, wherein said control disk (16) is eccentrically positioned with respect to the axis of rotation;

and the position sensor (19) is coupled to sense the outer circumference of said control disk to thereby sense the instantaneous rotary position of the control disk, and hence of the rotating chuck and of the workpiece.

14. Apparatus according to claim 1, further comprising a counter support element (39) axially movable conjointly with the operating head (24) and located to support the outer circumference of the workpiece (7);

and a common slider (22) axially movable with respect to the workpiece and securing the counter support and the operating head.

15. Apparatus according to claim 14, further including a resilient holding coupling (38,41–45) resiliently supporting the counter support on the slider (22) to provide for resilient counter supporting of the workpiece diametrically opposite the operating element (28) of the outer wall of the workpiece.

16. Method for accurately centering the alignment of a wall portion of a rotation symmetrical, hollow workpiece (7), in which the workpiece had a deflected portion, deviating from the axis of rotation thereof, and utilizing the apparatus claimed in claim 1 comprising the steps of determining the area of maximum deflection of the outer wall of the workpiece in a cross-sectional plane;

positioning the operating head within the hollow workpiece at said cross-sectional plane;

rotating the workpiece about its longitudinal axis;

and applying deforming energy to the inner wall of the workpiece by applying deforming energy by the operating element (28) against the inner wall of the workpiece, changing the deforming energy to the workpiece with the rotary position of the maximum deflection area with respect to the operating head, by controlling the operating element to exert maximum deforming energy at the position of maximum deformation from desired concentricity and minimum energy at a position 180° with respect to said maximum deflection, the change of application of energy changing continuously during rotation of the workpiece in accordance with said circumferential position.

17. The method of claim 16, wherein the step of applying deformation energy comprises hammering against the inner wall of the workpiece; and the step of changing application of energy during rotation of the workpiece comprises changing the frequency of the hammering operation as a function of the positioning of the oscillating operating element hammering against the respective inner wall portion of the workpiece from the minimum distance of the wall portion with respect to said axis of rotation.

18. Method for providing an accurately centered wall portion of a rotational symmetrical workpiece, having an at least partially dented, depressed outer wall zone utilizing the apparatus claimed in claim 1 said method comprising the steps of determining the deflection of the outer wall of the workpiece from round position;

placing the operating head (24) at the position of maximum dented position of the workpiece;

controlling the operating element on the operating head, and said force means to apply maximum deformation energy against the dented portion of the outer wall by hammering against an inner wall of the workpiece and, rotating the workpiece about its longitudinal axis;

changing application of energy during rotation of the workpiece by changing the frequency of the hammering operation as a function of the position of the oscillating element (28) against the respective inner wall portion of the workpiece with respect to the maximum deviation of the dent from said axis of rotation; and thereafter, relatively moving the operating head and the workpiece axially in the region of the depression or dent of the outer wall until the depressed zone or dent of the outer wall is essentially eliminated or falls within tolerance limits.

19. Method for accurately centering the alignment of a wall portion of a rotational symmetrical hollow workpiece (7) comprising the steps of measuring the outer wall of the workpiece (7) and determining the minimum distance of the wall portion from the longitudinal axis of the workpiece;

introducing a hammering element (27,28) into the workpiece and hammering, from the inside of the workpiece, the wall portion which has the minimum distance from the axis of rotation, toward the outside;

rotating said workpiece about the longitudinal axis relatively moving the hammering element with respect to said wall portion in at least one of the directions: axially; circumferentially, with respect to the axis of rotation of the rotation symmetrical workpiece;

and changing the frequency of hammering operation as a function of the rotation position of the hammering element against the respective inner wall portion of the workpiece from the minimum distance of the wall portion with respect to said wall portion.

* * * * *